US010336968B2

(12) United States Patent
Carswell et al.

(10) Patent No.: US 10,336,968 B2
(45) Date of Patent: Jul. 2, 2019

(54) LAUNDRY LIQUID COMPOSITION COMPRISING A POLYESTER/BUTYL GLYCOL/WATER ACTIVE BLEND

(71) Applicant: Conopco, Inc., Englewood Cliffs, NJ (US)

(72) Inventors: Robert John Carswell, Irby (GB); Carsten Cohrs, Frankfurt am Main (DE); Richard Michael Craven, Wirral (GB); David Philip Jones, Hawarden (GB); Peter Eugen Klug, Grossostheim (DE); Helen Elspeth Lyon, Wirral (GB); Peter Helmut Erich Naumann, Taunusstein (DE); Alyn James Parry, Neston (GB); Henricus Wilhelmus Ida Peerlings, Spabrücken (DE); Alastair Richard Sanderson, Ellesmere Port (GB); Andrew Wynne, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 15/323,501

(22) PCT Filed: Jul. 2, 2015

(86) PCT No.: PCT/EP2015/065136

§ 371 (c)(1),
(2) Date: Jan. 3, 2017

(87) PCT Pub. No.: WO2016/005271

PCT Pub. Date: Jan. 14, 2016

(65) Prior Publication Data

US 2017/0137755 A1 May 18, 2017

(30) Foreign Application Priority Data

Jul. 9, 2014 (EP) ..... 14176406

(51) Int. Cl.

| | |
|---|---|
| ***C11D 3/30*** | (2006.01) |
| ***C11D 3/20*** | (2006.01) |
| ***C11D 3/37*** | (2006.01) |
| ***C11D 11/00*** | (2006.01) |

(52) U.S. Cl.

CPC ..... *C11D 3/30* (2013.01); *C11D 3/2044* (2013.01); *C11D 3/2068* (2013.01); *C11D 3/3715* (2013.01); *C11D 11/0017* (2013.01); *C11D 11/0094* (2013.01)

(58) Field of Classification Search

CPC ..... C11D 1/83

See application file for complete search history.

(56) References Cited

U.S. PATENT DOCUMENTS 9,365,806 B2 * 6/2016 Carswell ..... C11D 3/30

FOREIGN PATENT DOCUMENTS

| | | | |
|---|---|---|---|
| CN | 103347927 | | 10/2013 |
| CN | 103347928 | | 10/2013 |
| DE | 102007005532 | | 8/2008 |
| DE | 102007013217 | | 9/2008 |
| EP | 0964015 | | 12/1999 |
| EP | 1661933 | | 5/2006 |
| EP | 2692842 | | 2/2014 |
| WO | WO2012104158 | | 8/2012 |
| WO | WO2012104159 | | 8/2012 |
| WO | 2014019658 | * | 2/2014 |
| WO | WO2014019658 | | 2/2014 |
| WO | WO2014019903 | | 2/2014 |

OTHER PUBLICATIONS

Search Report and Written Opinion in EP14176406 dated Jan. 26, 2015.

Search Report and Written Opinion in PCTEP2015065136.

* cited by examiner

*Primary Examiner* — Charles I Boyer

(74) *Attorney, Agent, or Firm* — Greenberg Traurig, LLP

(57) ABSTRACT

Storage-stable compositions comprising soil release polymers. Compositions are described comprising A) of from 45 to 55% by weight of one or more polyesters according to the following formula (I) wherein R and $R^2$ independently of one another are X—$(OC_2H_4)$n—$(OC_3H6)_m$ wherein X is $C_{1-4}$alkyl, the —$(OC_2H_4)$ groups and the —$(OC_3H6)$ groups are arranged blockwise and the block consisting of the —$(OC_3H_6)$ groups is bound to a COO group or are HO—$(C_3H_6)$ n is based on a molar average a number of from 12 to 120, m is based on a molar average a number of from 1 to 10, and a is based on a molar average a number of from 4 to 9, and B) of from 10 to 30% by weight of one or more alcohols selected from the group consisting of ethylene glycol, 1,2-propylene glycol, 1,3 -propylene glycol, 1,2 -butylene glycol, 1,3 -butylene glycol, 1,4 -butylene glycol and butyl glycol and C) of from 24 to 42% by weight of water, the amounts in each case being based on the total weight of the composition. The compositions may advantageously be used in laundry detergent and fabric care products. Process for making laundry liquid compositions comprising said active blend.

(I)

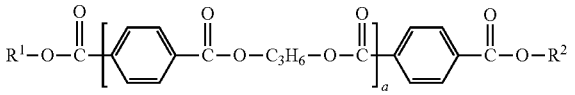

24 Claims, No Drawings

LAUNDRY LIQUID COMPOSITION COMPRISING A POLYESTER/BUTYL GLYCOL/WATER ACTIVE BLEND

The invention relates to laundry liquid compositions comprising polyesters and methods for making compositions comprising polyesters.

DE 10 2007 013 217 A1 and WO 2007/079850 A1 disclose anionic polyesters that may be used as soil release components in washing and cleaning compositions.

DE 10 2007 005 532 A1 describes aqueous formulations of soil release oligo- and polyesters with a low viscosity.

EP 0 964 015 A1 discloses soil release oligoesters that may be used as soil release polymers in detergents and that are prepared using polyols comprising 3 to 6 hydroxyl groups.

EP 1 661 933 A1 is directed to at room temperature flowable, amphiphilic and nonionic oligoesters prepared by reacting dicarboxylic acid compounds, polyol compounds and water-soluble alkylene oxide adducts and their use as additive in washing and cleaning compositions.

Accordingly and in regard to a first aspect there is provided an alkaline laundry liquid composition comprising at least 1% by weight triethanolamine, at least 5% non-soap surfactant and at least 0.5% a polyester provided as an active blend comprising:

A) from 45 to 55% by weight of the active blend of one or more polyesters according to the following formula (I)

(I)

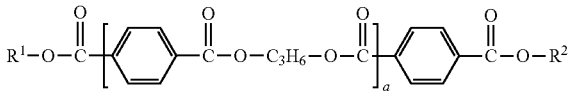

wherein $R^1$ and $R^2$ independently of one another are X—$(OC_3H_6)_m$ wherein X is $C_{1-4}$ alkyl and preferably methyl, the —$(OC_3H_4)$ groups and the —$(OC_3H_6)$ groups are arranged blockwise and the block consisting of the —$(OC_3H_6)$, and groups is bound to a COO group or are HO—$(C_3H_6)$, and preferably are independently of one another X—$(OC_2H_4)_n$—$(OC_3H_6)_m$, n is based on a molar average a number of from 12 to 120 and preferably of from 40 to 50, m is based on a molar average a number of from 1 to 10 and preferably of from 1 to 7, and a is based on a molar average a number of from 4 to 9 and B) from 10 to 30% by weight of the active blend of one or more alcohols selected from the group consisting of ethylene glycol, 1,2-propylene glycol, 1,3-propylene glycol, 1,2-butylene glycol, 1,3-butylene glycol, 1,4-butylene glycol and butyl glycol and C) from 24 to 42% by weight of the active blend of water.

By active blend is meant that it is preformed and added to the remainder of the laundry liquid composition, or to components which ultimately form the laundry liquid composition.

Preferably, butyl glycol has the following structure: $CH_3(CH_2)_3OCH_2CH_2OH$.

Surprisingly, the active blend is based on water and on solvents that are not easily flammable.

Aqueous or aqueous-alcoholic solutions of the polyesters often possess a relatively good stability when stored at 5° C. However, when stored at 25° C. for a longer period of time and even faster at elevated temperatures of from 30to 50° C., that may occur during transport or storage, non-inventive compositions of the polyesters at first show a turbidity during storage that later results in massive precipitations. These precipitations cannot be dissolved again at 80° C., meaning that the respective products may not be regarded as being storage-stable, and their properties are changed irreversibly by storage at elevated temperature.

The active blend is sufficiently storage-stable, also at elevated temperatures. The active blend compositions preferably are solutions at 25° C.

In the polyesters of component A) group "X" is $C_{1-4}$ alkyl and preferably is methyl.

In a preferred embodiment of the invention the polyesters of component A) of the inventive compositions are according to the following formula (I)

(I)

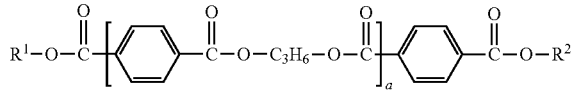

wherein $R^1$ and $R^2$independently of one another are $H_3C$—$(OC_2H_4)_n$—$(OC_2H_4)_m$ wherein the —$(OC_2H_4)$ groups and the —$(OC_3H_6)$ groups are arranged blockwise and the block consisting of the —$(OC_3H_6)$ groups is bound to a COO group or are HO—$(C_3H_6)$, and preferably are independently of one another $H_3C$—$(OC_2H_4)_n$—$(OC_3H_6)_m$, n is based on a molar average a number of from 40 to 50, m is based on a molar average a number of from 1 to 7, and a is based on a molar average a number of from 4 to 9.

In the polyesters of component A) of the inventive compositions variable "a" based on a molar average preferably is a number of from 5 to 8 and more preferably is a number of from 6 to 7.

In the polyesters of component A) of the inventive compositions variable "m" based on a molar average preferably is a number of from 2 to 5.

In the polyesters of component A) of the inventive compositions variable "n" based on a molar average preferably is a number of from 43 to 47, more preferably is a number of from 44 to 46 and even more preferably is 45.

In one particularly preferred embodiment of the invention the polyesters of component A) of the inventive compositions are according to the following formula (I)

(I)

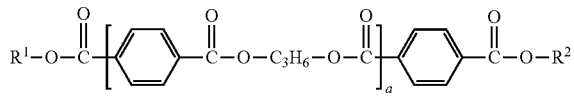

wherein $R^1$ and $R^2$ independently of one another are $H_3C$—$(OC_2H_4)_n$—$(OC_3H_6)_m$ wherein the —$(OC_2H_4)$ groups and the —$(OC_3H_6)$ groups are arranged blockwise and the block consisting of the —$(OC_3H_6)$ groups is bound to a COO group, n is based on a molar average a number of from 44 to 46, m is based on a molar average 2, and a is based on a molar average a number of from 5 to 8.

Among these polyesters the polyesters according to formula (I)

(I)

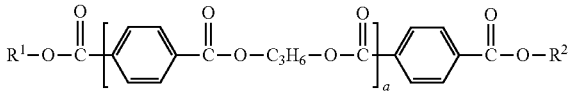

wherein $R^1$ and $R^2$ independently of one another are $H_3C—(OC_2H_4)_m$ wherein the $—(OC_2H_4)$ groups and the $—(OC_3H_6)$ groups are arranged blockwise and the block consisting of the $—(OC_3H_6)$ groups is bound to a COO group, n is based on a molar average 45, m is based on a molar average 2, and a is based on a molar average a number of from 6 to 7 are especially preferred.

In another particularly preferred embodiment of the invention the polyesters of component A) of the inventive compositions are according to the following formula (I)

(I)

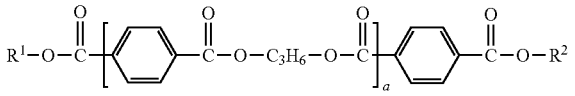

wherein $R^1$ and $R^2$ independently of one another are $H_3C—(OC_2H_4)_n—(OC_3H_6)_m$ wherein the $—(OC_2H_4)$ groups and the $—(OC_3H_6)$ groups are arranged blockwise and the block consisting of the $—(OC_3H_6)$ groups is bound to a COO group, n is based on a molar average a number of from 44 to 46, m is based on a molar average 5, and a is based on a molar average a number of from 5 to 8.

Among these polyesters the polyesters according to formula (I)

(I)

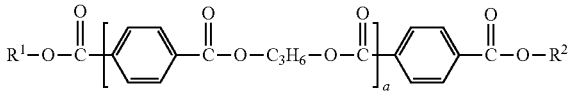

wherein $R^1$ and $R^2$ independently of one another are $H_3C—(OC_2H_4)_n—(OC_3H_4)_m$ wherein the $—(OC_2H_4)$ groups and the $—(OC_3H_6)$ groups are arranged blockwise and the block consisting of the $—(OC_3H_6)$ groups is bound to a COO group, n is based on a molar average 45, m is based on a molar average 5, and a is based on a molar average a number of from 6 to 7 are especially preferred.

The groups $—O—C_2H_4—$ in the structural units "$X—(OC_2H_4)_n—(OC_3H_6)_m$" or "$H_3C—(OC_2H_4)_n—(OC_3H_6)_m$" are of the formula $—O—CH_2—CH_2—$.

The groups $—O—C_3H_6—$ in the structural units indexed with "a", in the structural units "$X—(OC_2H_4)_n—(OC_3H_6)_m$" or "$H_3C—(OC_2H_4)_n—(OC_3H_6)_m$" and in the structural units $HO—(C_3H_6)$ are of the formula $—O—CH(CH_3)—CH_2—$ or $—O—CH_2—CH(CH_3)—$, i.e. are of the formula

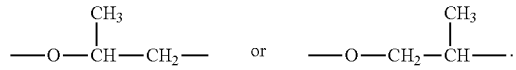

REM: COMPOSITIONS

The active blend compositions may advantageously be used in laundry detergent and fabric care products and in particular in liquid laundry detergent and fabric care products. These laundry detergent and fabric care products may comprise one or more optional ingredients, e.g. they may comprise conventional ingredients commonly used in laundry detergent and fabric care products. Examples of optional ingredients include, but are not limited to builders, surfactants, bleaching agents, bleach active compounds, bleach activators, bleach catalysts, photobleaches, dye transfer inhibitors, color protection agents, anti-redeposit ion agents, dispersing agents, fabric softening and antistatic agents, fluorescent whitening agents, enzymes, enzyme stabilizing agents, foam regulators, defoamers, malodour reducers, preservatives, disinfecting agents, hydrotopes, fibre lubricants, anti-shrinkage agents, buffers, fragrances, processing aids, colorants, dyes, pigments, anti-corrosion agents, fillers, stabilizers and other conventional ingredients for laundry detergent and fabric care products.

The active blend compositions have an advantageous stability in alkaline environment, possess a beneficial solubility and advantageously are clearly soluble in alkaline compositions such as heavy duty washing liquids and also possess advantageous soil release properties. In laundry detergent or fabric care products they result in a beneficial washing performance, in particular also after storage. Furthermore, they are storage stable at elevated temperature, i.e. they are clear solutions at elevated temperature also after a prolonged time of storage. In the context of a laundry liquid composition the active blend provides for:

ease of addition & potentially shorter batch cycle time better perfume, preservation & enzyme performance due to addition at lower temperature improved polymer delivery.

The polyesters of component A) of the active blend compositions may advantageously be prepared by a process which comprises heating dimethyl terephthalate (DMT), 1,2-propylene glycol (PG), and $X—(OC_2H_4)_n—(OC_3H_6)_m—OH$, wherein X is $C_{1-4}$ alkyl and preferably methyl, the $—(OC_2H_4)$ groups and the $—(OC_3H_6)$ groups are arranged blockwise and the block consisting of the $—(OC_3H_6)$ groups is bound to the hydroxyl group —OH and n and m are as defined for the polyesters of component A) of the inventive compositions, with the addition of a catalyst, to temperatures of from 160 to 220° C., firstly at atmospheric pressure, and then continuing the reaction under reduced pressure at temperatures of from 160 to 240° C.

Reduced pressure preferably means a pressure of from 0.1 to 900 mbar and more preferably a pressure of from 0.5 to 500 mbar.

Preferably, the process for the preparation of the polyesters of component A) of the inventive compositions is characterized in that a) dimethyl therephthalate, 1,2-propylene glycol, $X—(OC_2H_4)_n—(OC_3H_6)_m—OH$, wherein X is $C_{1-4}$ alkyl and preferably methyl, and a catalyst are added to a reaction vessel, heated under inert gas, preferably nitrogen, to a temperature of from 160° C. to 220° C. to remove methanol and then pressure is reduced to below atmospheric pressure, preferably to a pressure of from 200 to 900 mbar and more preferably to a pressure of from 400 to 600 mbar for completion of the transesterification, and b) in a second step the reaction is continued at a temperature of from 210° C. to 240 ° C. and at a pressure of from 0.1 to 10 mbar and preferably of from 0.5 to 5 mbar to form the polyester.

Sodium acetate (NaOAc) and tetraisopropyl orthotitanate (IPT) is preferably used as the catalyst system in the preparation of the polyesters of component A) of the inventive compositions.

The preparation of the polyesters of component A) of the active blend compositions is e.g. described in WO 2013/019658 A1.

Preferably, the one or more alcohols of component B) of the inventive compositions are selected from the group consisting of 1,2-propylene glycol, 1,3-propylene glycol and butylglycol.

More preferably, the alcohol of component B) of the inventive compositions is 1,2-propyleneglycol.

The active blend compositions preferably comprise of from 45 to 55% by weight of the one or more polyesters of component A), of from 15 to 25% by weight of the one or more alcohols of component B), and of from 24 to 40% by weight of water of component C), the amounts in each case being based on the total weight of the active blend.

The active blend may preferably comprise from 0 to 10% by weight, and more preferably from 0 to 5% by weight, of one or more additives, that may generally be used in detergent applications. Additives that may be used are e.g. sequestering agents, complexing agents, polymers different from the one or more polyesters of component A) of the inventive compositions, and surfactants.

Preferably, the active blend preferably comprises one or more additives (component D)), and in this case the amount of water of component C) preferably is of from 24 to 39.95% by weight, the amounts in each case being based on the total weight of the active blend.

The one or more additives of component D) of the active blend are preferably selected from the group consisting of sequestering agents, complexing agents, polymers different from the one or more polyesters of component A) and surfactants.

Suitable sequestering agents e.g. are polyacrylic acid or acrylic acid / maleic acid copolymers (e.g. Sokalan CP12S, BASF).

Suitable complexing agents e.g. are EDTA (ethylene diamine tetraactetate), diethylene triamine pentaacetate, nitrilotriacetic acid salts or iminodisuccinic acid salts.

Suitable polymers different from the one or more polyesters of component A) of the inventive compositions e.g. are dye transfer inhibitors such as e.g. vinyl pyrrolidone.

Suitable surfactants may be anionic surfactants such as lauryl sulfate, lauryl ether sulfate, alkane sulfonates, linear alkylbenzene sulfonates, methylester sulfonates, amine oxides or betaine surfactants.

Preferably, the one or more additives of component D) are present in the active blend compositions in an amount of up to 10% by weight, and in this case the amount of water of component C) in the active blend compositions preferably is of from 24 to 39.95% by weight, the amounts in each case being based on the total weight of the active blend.

More preferably, the one or more additives of component D) are present in the active blend compositions in an amount of from 0.1 to 10% by weight, and in this case the amount of water of component C) in the active blend compositions preferably is of from 24 to 39.9% by weight, the amounts in each case being based on the total weight of the active blend.

Even more preferably, the one or more additives of component D) are present in the active blend compositions in an amount of from 0.5 to 5% by weight, and in this case the amount of water of component C) in the active blend compositions preferably is of from 24 to 39.5% by weight, the amounts in each case being based on the total weight of the active blend compositions.

In a further preferred embodiment the active blend consists of the one or more polyesters of component A), the one or more alcohols of component B), and water of component C).

Preferably, the viscosity of the active blend compositions, measured at 25° C., is of from 200 to 5 000 mPa·s More preferably, the viscosity of the active blend compositions, measured at 25° C., is of from 500 to 2 000 mPa·s The viscosities are measured on the active blend compositions themselves using a Brookfield-viscosimeter, model DV II and the spindles of the set of spindles RV at 20 revolutions per minute and 25° C. Spindle No. 1 is used for viscosities of up to 500 mPa·s, spindle No. 2 for viscosities of up to 1 000 mPa·s, spindle No. 3 for viscosities of up to 5 000 mPa·s, spindle No. 4for viscosities of up to 10 000 mPa·s, spindle No. 5 for viscosities of up to 20 000 mPa·s, spindle No. 6 for viscosities of up to 50 000 mPa·s and spindle No. 7 for viscosities of up to 200 000 mPa·s.

In a second aspect there is provided a method for making a laundry liquid composition comprising adding an active blend as described above to a composition comprising cleansing surfactant selected from anionic surfactants and nonionic surfactants. Preferably, the method comprises adding the active blend as described herein and mixing before adding perfume, fragrance or preservative. Preferably, the temperature of the mixture of surfactants to which the active blend is added is not more than 50 C and preferably from 10 to 40 C.

Preferred preservatives include BIT (1,2-Benzoisothiazolin-3-one); MIT (Methylisothiazolinone); Phenoxyethanol, IPBC and mixtures thereof.

Preferred preservative systems include BIT (1,2-Benzoisothiazolin-3-one), BIT (1,2- Benzoisothiazolin-3-one) and MIT (Methylisothiazolinone); and Phenoxyethanol and BIT; Phenoxyethanol and IPBC.

In a third aspect there is provided a laundry liquid composition obtainable by a process according to the second aspect.

The examples below are intended to illustrate the invention in detail without, however, limiting it thereto. Unless explicitly stated otherwise, all percentages given are percentages by weight (% by wt. or wt.-%).

General Procedure for the Preparation of the Polyesters

The polyester synthesis is carried out by the reaction of dimethyl terephthalate (DMT), 1,2-propylene glycol (PG), and methyl polyalkyleneglycol using sodium acetate (NaOAc) and tetraisopropyl orthotitanate (IPT) as the catalyst system. The synthesis is a two-step procedure. The first step is a transesterification and the second step is a polycondensation.

Transesterification

Dimethyl terephthalate (DMT), 1,2-propylene glycol (PG), methyl polyalkyleneglycol, sodium acetate (anhydrous) (NaOAc) and tetraisopropyl orthotitanate (IPT) are weighed into a reaction vessel at room temperature.

For the melting process and homogenization, the mixture is heated up to 170° C. for 1 h and then up to 210° C. for a further 1 h sparged by a nitrogen stream. During the transesterification methanol is released from the reaction and is distilled out of the system (distillation temperature <55° C.). After 2 h at 210° C. nitrogen is switched off and the pressure is reduced to 400 mbar over 3 h.

Polycondensation

The mixture is heated up to 230 ° C. At 230° C. the pressure is reduced to 1 mbar over 160 min. Once the polycondensation reaction has started, 1,2-propylene glycol is distilled out of the system. The mixture is stirred for 4 h at 230 ° C. and a pressure of 1 mbar. The reaction mixture is cooled down to 140-150° C. Vacuum is released with nitrogen and the molten polymer is transferred into a glass bottle.

EXAMPLE I

| Amount [g] | Amount [mol] | Raw Material [Abbreviation] |
|---|---|---|
| 101.95 | 0.53 | DMT |
| 84.0 | 1.104 | PG |
| 343.5 | 0.15 | $H_3C—(OC_2H_4)_{45}—(OC_3H_6)_5—OH$ |
| 0.5 | 0.0061 | NaOAc |
| 0.2 | 0.0007 | IPT |

A polyester according to formula (I) is obtained wherein $R^1$ and $R^2$ are $H_3C—(OC_2H_4)_n—(OC_3H_6)_m$ wherein the $—(OC_2H_4)$ groups and the $—(OC_3H_6)$ groups are arranged blockwise and the block consisting of the $—(OC_3H_6)$ groups is bound to a COO group, n is based on a molar average 45, m is based on a molar average 5, and a is based on a molar average a number of from 6 to 7.

EXAMPLE II

| Amount [g] | Amount [mol] | Raw Material [Abbreviation] |
|---|---|---|
| 101.95 | 0.53 | DMT |
| 84.0 | 1.104 | PG |
| 317.4 | 0.15 | $H_3C—(OC_2H_4)_{45}—(OC_3H_6)_2—OH$ |
| 0.5 | 0.0061 | NaOAc |
| 0.2 | 0.0007 | IPT |

A polyester according to formula (I) is obtained wherein $R^1$ and $R^2$ are $H_3C—(OC_2H_4)_n—(OC_3H_6)_m$ wherein the $—(OC_2H_4)$ groups and the $—(OC_3H_6)$ groups are arranged blockwise and the block consisting of the $—(OC_3H_6)$ groups is bound to a COO group, n is based on a molar average 45, m is based on a molar average 2, and a is based on a molar average a number of from 6 to 7.

Stability Tests

Solutions according to the compositions of the following table have been prepared by dissolving the polyester in the respective mixture of water and alcoholic solvent. The additive Sokalan CP 12S was dissolved in the final mixture. The mixtures were investigated with respect to their stability in a storage cabinet (+=clear solution, o=turbidity, −=pronounced turbidity/precipitation). Freshly prepared samples are clear solutions.

The polyester of Example I (Ex. I) has been used for the stability tests.

Sokalan CP 12S (acrylic acid/maleic acid copolymer, BASF) has been used as the additive.

From the table it can be seen that solutions of the soil release polyesters in water (Examples 1-4) become turbid at 45° C. already after two weeks of storage. Inventive compositions comprising 1,2-propylene glycol or butyl glycol are still clear after 4 weeks of storage at 45° C.

EXAMPLE III

Process for making laundry liquid composition.

Optical brightener, salt, acids, alkalis & hydrotrope are added to water followed by the surfactants in order: nonionic, LAS then the fatty acid. SLES is then injected in line using a mill. Once SLES is dispersed Texcare SRN UL 50, ex. Clariant (the polyester active blend) is then added. In a separate vessel a pre-mix of dyes & water is made which is then added to the main mixer. After this point the minors are added (preservation & perfume & enzymes if applicable).

| Example | Polyester of Ex. I [wt.-%] | Water [wt.-%] | 1,2-Propy-lene glycol [wt.-%] | Butyl glycol [wt.-%] | Glycerol [wt.-%] |
|---|---|---|---|---|---|
| 1 | 35 | 65 | | | |
| 2 | 35 | 64 | | | |
| 3 | 40 | 60 | | | |
| 4 | 50 | 50 | | | |
| 5 | 45 | 44 | 10 | | |
| 6 | 45 | 39 | 15 | | |
| 7 | 45 | 34 | 20 | | |
| 8 | 45 | 24 | 30 | | |
| 9 | 45 | 44 | | 10 | |
| 10 | 45 | 39 | | 15 | |
| 11 | 45 | 34 | | 20 | |
| 12 | 50 | 40 | 10 | | |
| 13 | 50 | 40 | | 10 | |
| 14 | 50 | 39 | 10 | | |
| 15 | 50 | 39 | | 10 | |
| 16 | 55 | 34 | 10 | | |
| 17 | 55 | 34 | | 10 | |
| 18 | 50 | 30 | 20 | | |
| 19 | 50 | 35 | 15 | | |
| 20 | 50 | 29 | 20 | | |
| 21 | 50 | 25 | 25 | | |
| 22 | 50 | 30 | | 20 | |
| 23 | 40 | 50 | | | 10 |
| 24 | 45 | 45 | | | 10 |
| 25 | 40 | 49 | | | 10 |
| 26 | 45 | 44 | | | 10 |
| 27 | 50 | 30 | | | 20 |
| 28 | 50 | 30 | | | 20 |

| Example | Additive [wt.-%] | clarity at 45° C. after 2 weeks | clarity at 45° C. after 4 weeks | Viscosity at 25° C. [mPa · s] |
|---|---|---|---|---|
| 1 | | − | − | 250 |
| 2 | 1 | − | − | 260 |
| 3 | | − | − | 850 |
| 4 | | − | − | 3300 |
| 5 | 1 | − | − | |
| 6 | 1 | + | + | |
| 7 | 1 | + | + | |

-continued

| Example | Additive [wt.-%] | clarity at 45° C. after 2 weeks | clarity at 45° C. after 4 weeks | Viscosity at 25° C. [mPa · s] |
|---|---|---|---|---|
| 8 | 1 | + | + | |
| 9 | 1 | – | – | |
| 10 | 1 | + | + | |
| 11 | 1 | + | + | |
| 12 | | + | + | |
| 13 | | + | + | |
| 14 | 1 | + | + | |
| 15 | 1 | + | + | |
| 16 | | + | o | |
| 17 | | + | + | |
| 18 | | + | + | 1170 |
| 19 | | + | + | 1260 |
| 20 | 1 | + | + | 1170 |
| 21 | | + | + | 870 |
| 22 | | + | o | 285 |
| 23 | | – | – | |
| 24 | | – | – | |
| 25 | 1 | – | – | |
| 26 | 1 | – | – | |
| 27 | | – | – | |
| 28 | | – | – | |

The invention claimed is:

1. A process for making an alkaline laundry liquid composition comprising at least 1% wt. of the composition triethanolamine, at least 5% wt. of the composition non-soap surfactant and at least 0.5% wt. of the composition of a polyester, the polyester being provided as an active blend, the process comprising adding the active blend to a composition comprising cleansing surfactant selected from anionic surfactants and nonionic surfactants characterized in that the active blend comprises:

A) from 45 to 55% by weight of the active blend one or more polyesters according to the following formula (I)

(I)

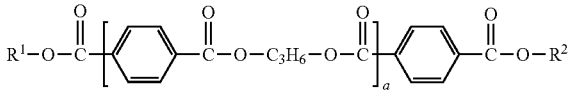

wherein $R^1$ and $R^2$ independently of one another are X—$(OC_2H_4)_n$—$(OC_3H_6)_m$ wherein X is $C_{1-4}$ alkyl, the —$(OC_2H_4)$ groups and the —$(OC_3H_6)$ groups are arranged blockwise and the block consisting of the —$(OC_3H_6)$ groups is bound to a COO group or are HO—$(C_3H_6)$, n is based on a molar average a number of from 12 to 120, m is based on a molar average a number of from 1 to 10, and a is based on a molar average a number of 4 to 9 and B) from 10 to 30% by weight of the active blend of butyl glycol and C) from 24 to 42% by weight of the active blend water.

2. The process according to claim 1, characterized in that in the one or more polyesters of component A)

$R^1$ and $R^2$ independently of one another are $H_3C$—$(OC_2H_4)_n$—$(OC_3H_6)_6$wherein the —$(OC_2H_4)$ groups and the —$(OC_3H_6)$ groups are arranged blockwise and the block consisting of the —$(OC_3H_6)$ groups is bound to a COO group or are HO—$(C_3H_6)$, and are independently of one another $H_3C$—$(OC_2H_4)_n$—$(OC_3H_6)_m$, n is based on a molar average a number of from 40 to 50, m is based on a molar average a number of from 1 to 7, and a is based on a molar average a number of from 4 to 9.

3. The process according to claim 1, characterized in that in the one or more polyesters of component A) a based on a molar average is a number of from 5 to 8.

4. The process according to claim 3, characterized in that in the one or more polyesters of component A) a based on a molar average is a number of from 6 to 7.

5. The process according to claim 1, characterized in that in the one or more polyesters of component A) m based on a molar average is a number of from 2 to 5.

6. The process according to claim 1, characterized in that in the one or more polyesters of component A) n based on a molar average is a number of from 43 to 47.

7. The process according to claim 6, characterized in that in the one or more polyesters of component A) n based on a molar average is a number of from 44 to 46.

8. The process according to claim 7, characterized in that in the one or more polyesters of component A) n based on a molar average is 45.

9. The process according to claim 1, characterized in that in the one or more polyesters of component A)

$R^1$ and $R^2$ independently of one another are $H_3C$—$(OC_2H_4)_n$—$(OC_3H_6)_m$ wherein the —$(OC_2H_4)$ groups and the —$(OC_3H_6)$ groups are arranged blockwise and the block consisting of the –$(OC_3H6)$ groups is bound to a COO group, n is based on a molar average a number of from 44 to 46, m is based on a molar average 2, and a is based on a molar average a number of from 5 to 8.

10. The process according to claim 9, characterized in that in the one or more polyesters of component A) n based on a molar average is 45, and a based on a molar average is a number of from 6 to 7.

11. The process according to claim 1, characterized in that in the one or more polyesters of component A)

$R^1$ and $R^2$ independently of one another are $H_3C$—$(OC_2H_4)_n$—$(OC_3H6)_m$ wherein the —$(OC_2H_4)$ groups and the —$(OC_3H6)$ groups are arranged blockwise and the block consisting of the —$(OC_3H6)$ groups is bound to a COO group, n is based on a molar average a number of from 44 to 46, m is based on a molar average 5, and a is based on a molar average a number of from 5 to 8.

12. The process according to claim 11, characterized in that in the one or more polyesters of component A) n based on a molar average is 45, and a based on a molar average is a number of from 6 to 7.

13. The process according to claim 1, characterized in that the active blend comprises of from 45 to 55% by weight of the active blend of the butyl glycol or more polyesters of component A), of from 15 to 25% by weight of the active blend of the butyl glycol, and of from 24 to 40% by weight of the active blend water of component C).

14. The process according to claim 1, characterized in that it comprises one or more additives (component D)), and in this case the amount of water preferably is of from 24 to 39.95% by weight of the active blend.

15. The process according to claim 14, characterized in that the one or more additives of component D) are selected from the group consisting of sequestering agents, complexing agents, polymers different from the one or more polyesters of component A) and surfactants.

16. The process according to claim 14, characterized in that the one or more additives of component D) are present in the composition in an amount of up to 10% by weight of the active blend, and in this case the amount of water is of from 24 to 39.95% by weight of the active blend.

17. The process according to claim 14, characterized in that the one or more additives of component D) are present in the composition in an amount of from 0.1 to 10% by weight, and in this case the amount of water is of from 24 to 39.9 % by weight, the amounts in each case being based on the total weight of the active blend.

18. The process according to claim 14, characterized in that the one or more additives of component D) are present in the composition in an amount of from 0.5 to 5% by weight, and in this case the amount of water is of from 24 to 39.5% by weight, the amounts in each case being based on the total weight of the active blend.

19. The process according to claim 1, characterized in that the active blend consists of the one or more polyesters of component A), butyl glycol, and water.

20. The process according to claim 1, characterized in that its viscosity of the active blend measured at 25 ° C. is of from 200 to 5 000 mPa·s.

21. The process according to claim 20, characterized in that its viscosity of the active blend measured at 25 ° C. is of from 500 to 2 000 mPa·s.

22. The process according to claim 1 wherein the method comprises adding the active blend as described herein and mixing before adding perfume, fragrance or preservative.

23. The process according to claim 1 wherein the temperature of the mixture of surfactants to which the active blend is added is not more than 50° C.

24. An alkaline laundry liquid composition comprising at least 1% wt. of the composition triethanolamine, at least 5% wt. of the composition non-soap surfactant and at least 0.5% wt. of the composition of a polyester, characterized in that the polyester is provided as an active blend comprises:

A) from 45 to 55% by weight of the active blend one or more polyesters according to the following formula (I)

(I)

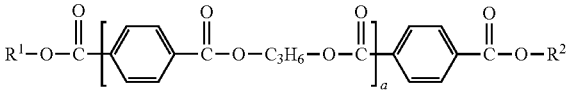

wherein $R^1$ and $R^2$ independently of one another are $X—(OC_2H_4)_n—(OC_3H_6)_m$ wherein X is $C_{1-4}$ alkyl, the $—(OC_2H_4)$ groups and the $—(OC_3H_6)$ groups are arranged blockwise and the block consisting of the $—(OC_3H_6)$ groups is bound to a COO group or are HO—(C3H6), and are independently of one another $X—(OC_2H_4)_n—(OC_3H_6)_m$, n is based on a molar average a number of from 12 to 120, m is based on a molar average a number of from 1 to 10, and a is based on a molar average a number of from 4 to 9 and B) from 10 to 30% by weight of the active blend of butyl glycol, and C) from 24 to 42% by weight of the active blend water.

* * * * *